US008168943B2

(12) United States Patent
Schwartz et al.

(10) Patent No.: US 8,168,943 B2
(45) Date of Patent: May 1, 2012

(54) DATA-DEPENDENT SELECTION OF DISSOCIATION TYPE IN A MASS SPECTROMETER

(75) Inventors: Jae C. Schwartz, San Jose, CA (US); John E. P. Syka, Charlottesville, VA (US); Andreas F. R. Huhmer, Mountain View, CA (US); Joshua J. Coon, Middleton, WI (US)

(73) Assignee: Thermo Finnigan LLC, San Jose, CA (US)

( * ) Notice: Subject to any disclaimer, the term of this patent is extended or adjusted under 35 U.S.C. 154(b) by 764 days.

(21) Appl. No.: 11/845,723

(22) Filed: Aug. 27, 2007

(65) Prior Publication Data

US 2008/0048109 A1 Feb. 28, 2008

Related U.S. Application Data

(60) Provisional application No. 60/840,198, filed on Aug. 25, 2006.

(51) Int. Cl.
*H01J 49/00* (2006.01)

(52) U.S. Cl. ..... 250/282; 250/281

(58) Field of Classification Search ..... None
See application file for complete search history.

(56) References Cited

U.S. PATENT DOCUMENTS 3,553,452 A * 1/1971 Tiernan et al. ..... 250/287
4,297,191 A * 10/1981 Chen ..... 204/193
5,905,258 A * 5/1999 Clemmer et al. ..... 250/287
6,342,393 B1 * 1/2002 Hofstadler et al. ..... 436/173
6,373,051 B1 * 4/2002 Hayakawa et al. ..... 250/282
6,710,336 B2 * 3/2004 Wells ..... 250/292
6,744,040 B2 * 6/2004 Park ..... 250/281
6,745,134 B2 * 6/2004 Kobayashi et al. ..... 702/27
6,872,941 B1 * 3/2005 Whitehouse et al. ..... 250/288

(Continued)

FOREIGN PATENT DOCUMENTS

WO WO 2006/129083 A2 12/2006

OTHER PUBLICATIONS

David L. Tabb, et al, "Determination of Peptide and Protein Ion Charge States by Fourier Transformation of Isotope-Resolved Mass Spectra," Journal of the American Society for Mass Spectrometry, Elsevier Science Inc. (US), vol. 17 ( No. 7), pp. 903-915, (2006).

Sharon J. Pitteri, et al., "Recent Developments in the Ion/Ion Chemistry of High-Mass Multiply Charged Ions," Mass Spectrometry Reviews, John Wiley & Sons Inc. (US), vol. 24 ( No. 6), pp. 931-958, (2005).

(Continued)

*Primary Examiner* — Jack Berman
*Assistant Examiner* — Andrew Smyth
(74) *Attorney, Agent, or Firm* — Charles B. Katz

(57) ABSTRACT

Methods and apparatus for data-dependent mass spectrometric MS/MS or $MS^n$ analysis are disclosed. The methods may include determination of the charge state of an ion species of interest, followed by automated selection of a dissociation type (e.g., CAD, ETD, or ETD followed by a non-dissociative charge reduction or collisional activation) based at least partially on the determined charge state. The ion species of interest is then dissociated in accordance with the selected dissociation type, and an MS/MS or $MS^n$ spectrum of the resultant product ions may be acquired.

19 Claims, 3 Drawing Sheets

U.S. PATENT DOCUMENTS

| | | | | |
|---|---|---|---|---|
| 6,907,352 | B2 * | 6/2005 | Yoshinari et al. | 702/23 |
| 6,924,478 | B1 * | 8/2005 | Zubarev et al. | 250/282 |
| 6,949,743 | B1 | 9/2005 | Schwartz | |
| 6,972,408 | B1 * | 12/2005 | Reilly | 250/292 |
| 7,009,174 | B2 | 3/2006 | LeBlanc | |
| 7,034,292 | B1 | 4/2006 | Whitehouse et al. | |
| 7,105,811 | B2 * | 9/2006 | Dantus et al. | 250/288 |
| 7,158,893 | B2 * | 1/2007 | Yoshinari et al. | 702/23 |
| 7,312,442 | B2 * | 12/2007 | Hansen | 250/282 |
| 7,381,373 | B2 * | 6/2008 | Blake et al. | 422/100 |
| 7,439,497 | B2 * | 10/2008 | Dantus et al. | 250/288 |
| 7,482,582 | B2 * | 1/2009 | Raznikov et al. | 250/287 |
| 7,498,568 | B2 * | 3/2009 | Overney et al. | 250/282 |
| 7,538,321 | B2 * | 5/2009 | Ishimaru et al. | 250/288 |
| 7,557,343 | B2 * | 7/2009 | Hansen et al. | 250/292 |
| 7,566,870 | B2 * | 7/2009 | Hasegawa et al. | 250/292 |
| 7,567,596 | B2 * | 7/2009 | Dantus et al. | 372/30 |
| 2002/0011563 | A1 * | 1/2002 | Griffey et al. | 250/288 |
| 2002/0162958 | A1 * | 11/2002 | Yoshinari et al. | 250/292 |
| 2003/0042412 | A1 * | 3/2003 | Park | 250/281 |
| 2003/0211628 | A1 * | 11/2003 | Griffey et al. | 436/173 |
| 2003/0213900 | A1 | 11/2003 | Hoyes | |
| 2004/0007666 | A1 * | 1/2004 | Griffey et al. | 250/282 |
| 2004/0041091 | A1 * | 3/2004 | Bateman et al. | 250/282 |
| 2004/0164240 | A1 * | 8/2004 | Okumura et al. | 250/288 |
| 2004/0188603 | A1 * | 9/2004 | Bateman et al. | 250/281 |
| 2005/0061966 | A1 * | 3/2005 | Ding et al. | 250/288 |
| 2005/0139761 | A1 * | 6/2005 | Yoshinari et al. | 250/282 |
| 2005/0199804 | A1 | 9/2005 | Hunt et al. | |
| 2006/0094121 | A1 * | 5/2006 | Reid et al. | 436/86 |
| 2006/0138320 | A1 * | 6/2006 | Bateman | 250/288 |
| 2006/0151689 | A1 * | 7/2006 | Bateman | 250/288 |
| 2006/0169892 | A1 | 8/2006 | Baba et al. | |
| 2006/0186331 | A1 * | 8/2006 | Hartmer et al. | 250/288 |
| 2006/0243900 | A1 * | 11/2006 | Overney et al. | 250/284 |
| 2006/0255263 | A1 * | 11/2006 | Ishimaru et al. | 250/288 |
| 2006/0289743 | A1 * | 12/2006 | Hasegawa et al. | 250/288 |
| 2006/0289746 | A1 * | 12/2006 | Raznikov et al. | 250/294 |
| 2006/0289747 | A1 * | 12/2006 | Schultz et al. | 250/294 |
| 2007/0057174 | A1 * | 3/2007 | Hansen | 250/282 |
| 2007/0057180 | A1 * | 3/2007 | Hansen et al. | 250/292 |
| 2007/0145264 | A1 * | 6/2007 | Specht et al. | 250/292 |
| 2007/0158544 | A1 | 7/2007 | Hartmer | |
| 2008/0042056 | A1 * | 2/2008 | Fischer et al. | 250/288 |
| 2008/0044915 | A1 * | 2/2008 | Hunt et al. | 436/89 |
| 2008/0191129 | A1 * | 8/2008 | Makarov et al. | 250/282 |
| 2008/0203288 | A1 * | 8/2008 | Makarov et al. | 250/282 |
| 2009/0032698 | A1 * | 2/2009 | Furuhashi et al. | 250/282 |
| 2009/0275495 | A1 * | 11/2009 | Ward et al. | 514/2 |

OTHER PUBLICATIONS

Christoph Stingl, et al., "Application of Different Fragmentation Techniques for the Analysis of Phosphopeptides Using a Hybrid Linear Ion Trap-FTICR Mass Spectrometer," Biochimica et Biophysica Acta (BBA)—Proteins & Proteomics, Elsevier, vol. 176 ( No. 12), pp. 1842-1852, (2006).

Cox et al., "Multiple Reaction Monitoring as a Method for Identifying Protein Posttranslational Modifications," J. Biomolecular Tech., vol. 16 (No. 2), p. 83-90, (2005).

Greenbaum et al., "Chemical Approaches for Functionally Probing the Proteome," Molecular & Cellular Proteomics 1.1, p. 60-68, (2002).

Huq et al., "Mapping of phosphorylation sites of nuclear corepressor receptor interacting protein 140 by liquid chromatography-tandem mass spectroscopy," Proteomics, vol. 5, p. 2157-2166, (2005).

Knudsen et al., "Proteomic Analysis of *Schistosoma mansoni* Cercarial Secretions," Molecular & Cellular Proteomics 4.12, p. 1862-1875, (2005).

Le Blanc et al., "Unique scanning capabilities of a new hybrid linear ion trap mass spectrometer (Q Trap) used for high sensitivity proteomics applications," Proteomics, vol. 3, p. 859-869, (2003).

Medzihradszky et al., "O-Sulfonation of Serine and Threonine—Mass Spectrometric Detection and Characterization of a New Post-translational Modification in Diverse Proteins Throughout the Eukaryotes," Molecular & Cellular Proteomics 3.5, p. 429-443, (2004).

Sandra et al., "The Q-Trap Mass Spectrometer, a Novel Tool in the Study of Protein Glycosylation," J Am Soc Mass Spectrom, vol. 15, p. 413-423, (2004).

Shevchenko et al., "Rapid 'de Novo' Peptide Sequencing by a Combination of Nanoelectrospray, Isotopic Labeling and a Quadrupole/Time-of-flight Mass Spectrometer," Rapid Comm in Mass Spectrom, vol. 11, p. 1015-1024, (1997).

Zhang et al., "A Universal Algorithm for Fast and Automated Charge State Deconvolution of Electrospray Mass-to-Charge Ratio Spectra," J Am Soc Mass Spectrom, vol. 9, p. 225-233, (1998).

Wenner et al., "Factors that Affect Ion Trap Data-Dependent MS/MS in Proteomics," J Am Soc Mass Spectrom, vol. 15, p. 150-157, (2004).

* cited by examiner

| | CAD | ETD | ETD+ CAD | ETD+ PTR |
|---|---|---|---|---|
| +1 | • | | | |
| +2 | | | • | |
| +3 | | • | | |
| +4 | | • | | |
| +5 | | • | | |
| +6 | | • | | |
| ≥+7 | | | | • |

FIG. 3

| | | CAD | ETD | ETD+ CAD | ETD+ PTR |
|---|---|---|---|---|---|
| +1 | All | • | | | |
| +2 | All | | | • | |
| +3 | <600 | | • | | |
| | >600 | | | • | |
| +4 | <700 | | • | | |
| | >700 | | | • | |
| +5 | <800 | | • | | |
| | >800 | | | • | |
| +6 | <800 | | • | | |
| | >800 | | | • | |
| ≥+7 | All | | | | • |

FIG. 4

DATA-DEPENDENT SELECTION OF DISSOCIATION TYPE IN A MASS SPECTROMETER

CROSS-REFERENCE TO RELATED APPLICATION

This application claims the priority benefit under 35 U.S.C. §119(e) of U.S. provisional patent application No. 60/840,198 entitled "Data-Dependent Selection of Fragmentation Type" filed on Aug. 25, 2006, the disclosure of which is incorporated herein by reference.

FIELD OF THE INVENTION

The present invention relates generally to mass spectrometry, and more particularly to automated acquisition of MS/MS and $MS^n$ spectra utilizing data-dependent methodologies.

BACKGROUND OF THE INVENTION

Data-dependent acquisition (also referred to, in various commercial implementations, as Information Dependent Acquisition (IDA), Data Directed Analysis (DDA), and AUTO MS/MS) is a valuable and widely-used tool in the mass spectrometry art, particularly for the analysis of complex samples. Generally described, data-dependent acquisition involves using data derived from an experimentally-acquired mass spectrum in an "on-the-fly" manner to direct the subsequent operation of a mass spectrometer; for example, a mass spectrometer may be switched between MS and MS/MS scan modes upon detection of an ion species of potential interest. Utilization of data-dependent acquisition methods in a mass spectrometer provides the ability to make automated, real-time decisions in order to maximize the useful information content of the acquired data, thereby avoiding or reducing the need to perform multiple chromatographic runs or injections of the analyte sample. These methods can be tailored for specific desired objectives, such as enhancing the number of peptide identifications from the analysis of a complex mixture of peptides derived from a biological sample.

Data-dependent acquisition methods may be characterized as having one or more input criteria, and one or more output actions. The input criteria employed for conventional data-dependent methods are generally based on parameters such as intensity, intensity pattern, mass window, mass difference (neutral loss), mass-to-charge (m/z) inclusion and exclusion lists, and product ion mass. The input criteria are employed to select one or more ion species that satisfy the criteria. The selected ion species are then subjected to an output action (examples of which include performing MS/MS or $MS^n$ analysis and/or high-resolution scanning). In one instance of a typical data-dependent experiment, a group of ions are mass analyzed, and ion species having mass spectral intensities exceeding a specified threshold are subsequently selected as precursor ions for MS/MS analysis, which may involve operations of isolation, dissociation of the precursor ions, and mass analysis of the product ions.

The growing use of mass spectrometry for the analysis of peptides, proteins, and other biomolecules has led researchers to develop new dissociation techniques, including pulsed-q dissociation (PQD) and electron transfer dissociation (ETD), that provide additional and/or different informational content relative to conventional techniques. However, the data-dependent acquisition methods described in the prior art have been largely limited to use with a single, conventional dissociation mode. While certain references in the prior art (see, e.g., LeBlanc et al., "Unique Scanning Capabilities of a New Hybrid Linear Ion Trap Mass Spectrometer (Q Trap) Used for High Sensitivity Proteomics Applications, *Proteomics*, vol. 3, pp. 859-869 (2003)) have described using data-dependent methods to automatically adjust dissociation parameters such as collision energy, there remains a need for novel data-dependent acquisition methods that can be employed with the recently developed advanced dissociation techniques to more fully exploit the opportunities for acquiring enhanced informational content.

SUMMARY

Roughly described, a method of automated mass spectrometric analysis implemented in accordance with an embodiment of the present invention includes steps of acquiring a mass spectrum of ions derived from a sample, analyzing the mass spectrum to select an ion species of interest, selecting a dissociation type from a list of distinct candidate dissociation types by applying specified criteria based at least partially on a determined charge state of the ion species of interest, and dissociating the ion species using the selected dissociation type to produce product ions. Examples of candidate dissociation types include collisionally activated dissociation (CAD), pulsed-q dissociation (PQD), photodissociation, electron capture dissociation (ECD), electron transfer dissociation (ETD), and ETD followed by one or more stages of supplemental collisional activation or proton transfer reactions (PTR). An MS/MS spectrum of the product ions may then be acquired. This process may be repeated one or more times to produce higher-generation product ions and to acquire the corresponding $MS^n$ spectra.

In another embodiment of the invention, a mass spectrometer is provided that includes an ion source for generating ions from a sample to be analyzed, a mass analyzer for acquiring a mass spectrum of the ions, and at least one dissociation device. The mass analyzer and dissociation device(s) may be integrated into a common structure, such as a two-dimensional ion trap mass analyzer. The mass analyzer and each dissociation device communicate with a controller, which is programmed to select an ion species of interest from the mass spectrum and to select an appropriate dissociation type from a list of candidate dissociation types by applying specified criteria based at least partially on the determined charge state of the ion species of interest. The controller then directs the ion dissociation device to dissociate the ion species using the selected dissociation type to produce product ions.

By expanding the concept of data-dependent methodologies to include selection of dissociation type, embodiments of the present invention make more effective use of the capabilities of a mass spectrometer instrument and facilitate production of more useful data. In one simple example, it is known that certain dissociation techniques (e.g., ETD) are characterized by a strong dependence of dissociation efficiency on ion charge state, and thus may not yield meaningful results when applied to ions having a low charge state. In such a case, the mass spectrometer may be programmed to limit its use of the charge-state dependent dissociation technique to ion species having the requisite charge state, and to use an alternative dissociation technique, such as CAD, for ion species that do not meet the charge state criteria.

BRIEF DESCRIPTION OF THE DRAWINGS

In the accompanying drawings:

FIG. 3 is a tabular representation of one example of a specified relationship between input criteria and dissociation type, wherein the input criteria is based solely on the charge state of the ion species; and FIG. 4 is a tabular representation of another example of a specified relationship between input criteria and dissociation type, wherein the input criteria is based both on the charge state and the mass-to-charge ratio (m/z) of the ion species.

DETAILED DESCRIPTION OF EMBODIMENTS

Figure 1:
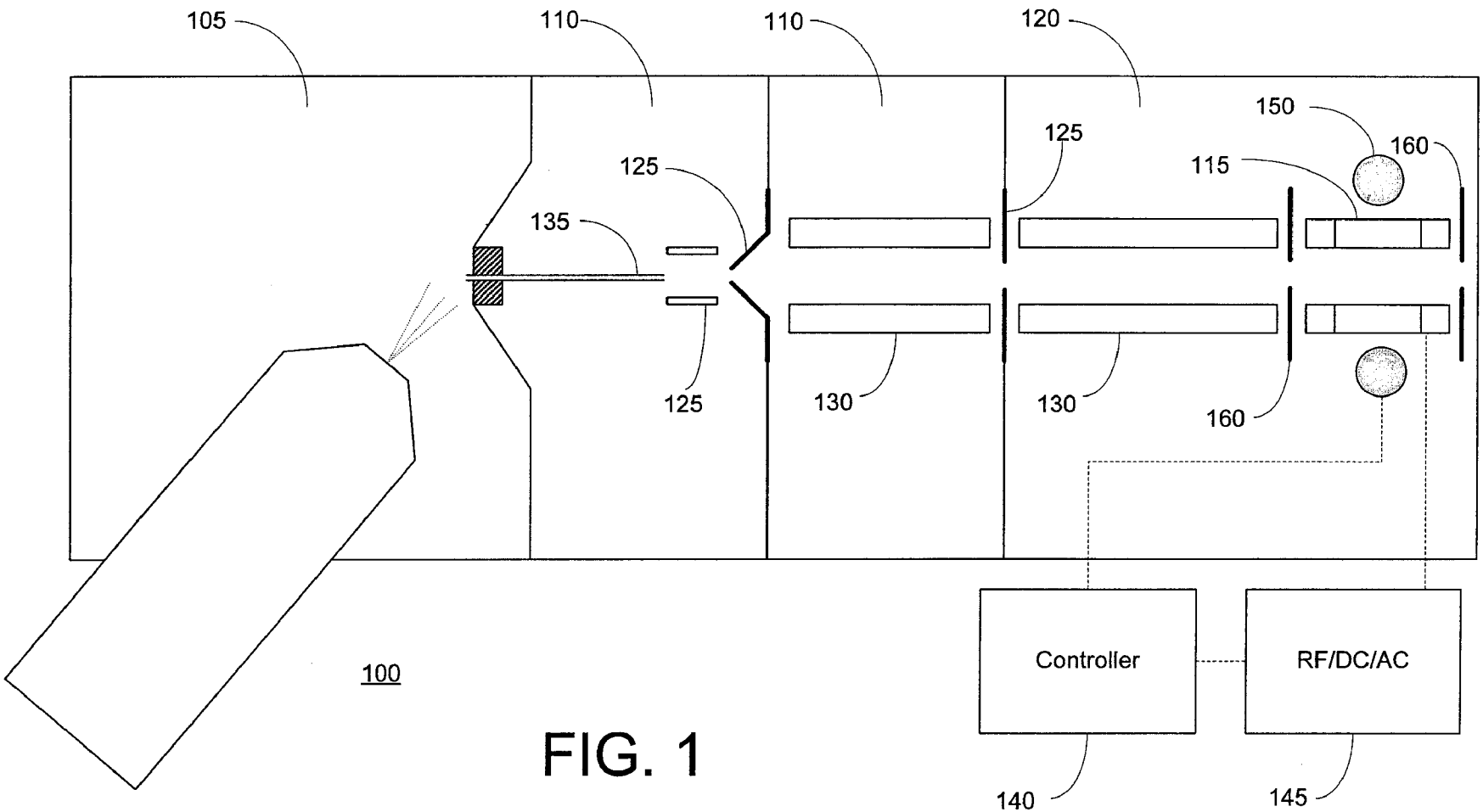
FIG. 1 is a schematic diagram of an example of a mass spectrometer system in which the data-dependent techniques of the present invention may be implemented.

FIG. 1 is a schematic depiction of a mass spectrometer 100 in which the data-dependent methods of the present invention may be beneficially implemented. It should be noted that mass spectrometer 100 is presented by way of a non-limiting example, and that the invention may be practiced in connection with mass spectrometer systems having architectures and configurations different from those depicted herein. Ions are generated from a sample to be mass analyzed, such as the eluate from a liquid chromatographic column, by an ion source 105. Ion source 105 is depicted as an electrospray source, but may alternatively take the form of any other suitable type of continuous or pulsed source. The ions are transported through intermediate chambers 110 of successively lower pressure and are subsequently delivered to a mass analyzer 115 located in vacuum chamber 120. Various ion optical devices, such as electrostatic lenses 125, radio-frequency (RF) multipole ion guides 130, and ion transfer tube 135, may be disposed in the intermediate and vacuum chambers 110 and 120 to provide ion focusing and ion-neutral separation and thereby assist in the efficient transport of ions through mass spectrometer 100.

As shown in FIG. 1, mass analyzer 115 may take the form of a two-dimensional quadrupole ion trap mass analyzer similar to that used in the LTQ mass spectrometer available from Thermo Fisher Scientific Inc. (San Jose, Calif.). It is noted that ion trap mass analyzers (including the two-dimensional ion trap depicted and described herein as well as three-dimensional ion traps) are capable of performing both mass analysis and dissociation functions within a common physical structure; other mass spectrometer systems may utilize separate structures for mass analysis and dissociation. Mass analyzer 115 (and/or one or more dissociation devices external to mass analyzer 115) is configured to dissociate ions by a selected one of a plurality of available dissociation techniques. In the present example, mass analyzer 130 may be controllably operable to dissociate ions by conventional CAD, by PQD (described in U.S. Pat. No. 6,949,743 to Schwartz, the entire disclosure of which is incorporated by reference), or by ETD (described in U.S. Patent Publication No. US2005/0199804 to Hunt et al., the entire disclosure of which is also incorporated by reference), used either alone or with a supplemental collisional activation, or with a non-dissociative charge-reducing reaction step, typically utilizing an ion-ion reaction such as PTR. As is described in U.S. Pat. No. 7,026,613 to Syka, the entire disclosure of which is incorporated by reference, charge-state independent axial confinement of ions for simultaneous trapping of analyte and reagent ions in a common region of a two-dimensional trap mass analyzer may be achieved by applying oscillatory voltages to end lenses 160 positioned adjacent to mass analyzer 115. The foregoing set of available dissociation types is intended merely as an example, and other implementations of the invention may utilize additional or different dissociation types, including but not limited to photodissociation, high-energy C-trap dissociation (abbreviated as HCD and described, for example, in Macek et al., "The Serine/Threonine/Tyrosine Phosphoproteome of the Model Bacterium *Bacillus subtilis*", Molecular and Cellular Proteomics, vol. 6, pp. 697-707 (2007)), and surface-induced dissociation (SID). It will be recognized that for ETD, a suitable structure (not depicted in FIG. 1) will be provided for supplying reagent (e.g., fluoranthene) ions to the interior volume of the mass analyzer or dissociation device for reaction with the multiply charged analyte cations and produce product cations.

Mass analyzer 115 is in electronic communication with a controller 140, which includes hardware and/or software logic for performing the data analysis and control functions described below. Controller 140 may be implemented in any suitable form, such as one or a combination of specialized or general purpose processors, field-programmable gate arrays, and application-specific circuitry. In operation, controller 140 effects desired functions of mass spectrometer 100 (e.g., analytical scans, isolation, and dissociation) by adjusting voltages applied to the various electrodes of mass analyzer 115 by RF, DC and AC voltage sources 145, and also receives and processes signals from detectors 160 representative of mass spectra. As will be discussed in further detail below, controller 140 may be additionally configured to store and run data-dependent methods in which output actions are selected and executed in real time based on the application of input criteria to the acquired mass spectral data. The data-dependent methods, as well as the other control and data analysis functions, will typically be encoded in software or firmware instructions executed by controller 140.

In a preferred embodiment, the instrument operator defines the data-dependent methods by specifying (via, for example, a command script or a graphical user interface) the input criteria (as used herein, references to "criteria" are intended to include an instance where a single criterion is utilized), output action(s), and the relationship between the input criteria and the output action(s). In a simple example, the operator may define a data-dependent method in which MS/MS analysis is automatically performed on the three ion species exhibiting the greatest intensities in the MS spectrum. As discussed above, data-dependent methods of this type are known in the art. The present invention expands the capabilities of data-dependent methodology by including within its scope additional input criteria (e.g., charge state), additional output actions (e.g., multiple dissociation types) and more complex relationships between the input criteria and output actions. In one representative example, which will be discussed in further detail in connection with FIG. 4, the operator may define a data-dependent method in which MS/MS analysis is performed on all ion species exhibiting an intensity above a given threshold, with the dissociation type being selected based on the m/z and charge state of the ion species of interest (e.g., CAD for singly-charged ions, ETD for multiply-charged ion species having an m/z below a specified limit, and ETD with a supplemental CAD excitation for multiply-charged ion species having an m/z in excess of a specified limit.)

Figure 2:
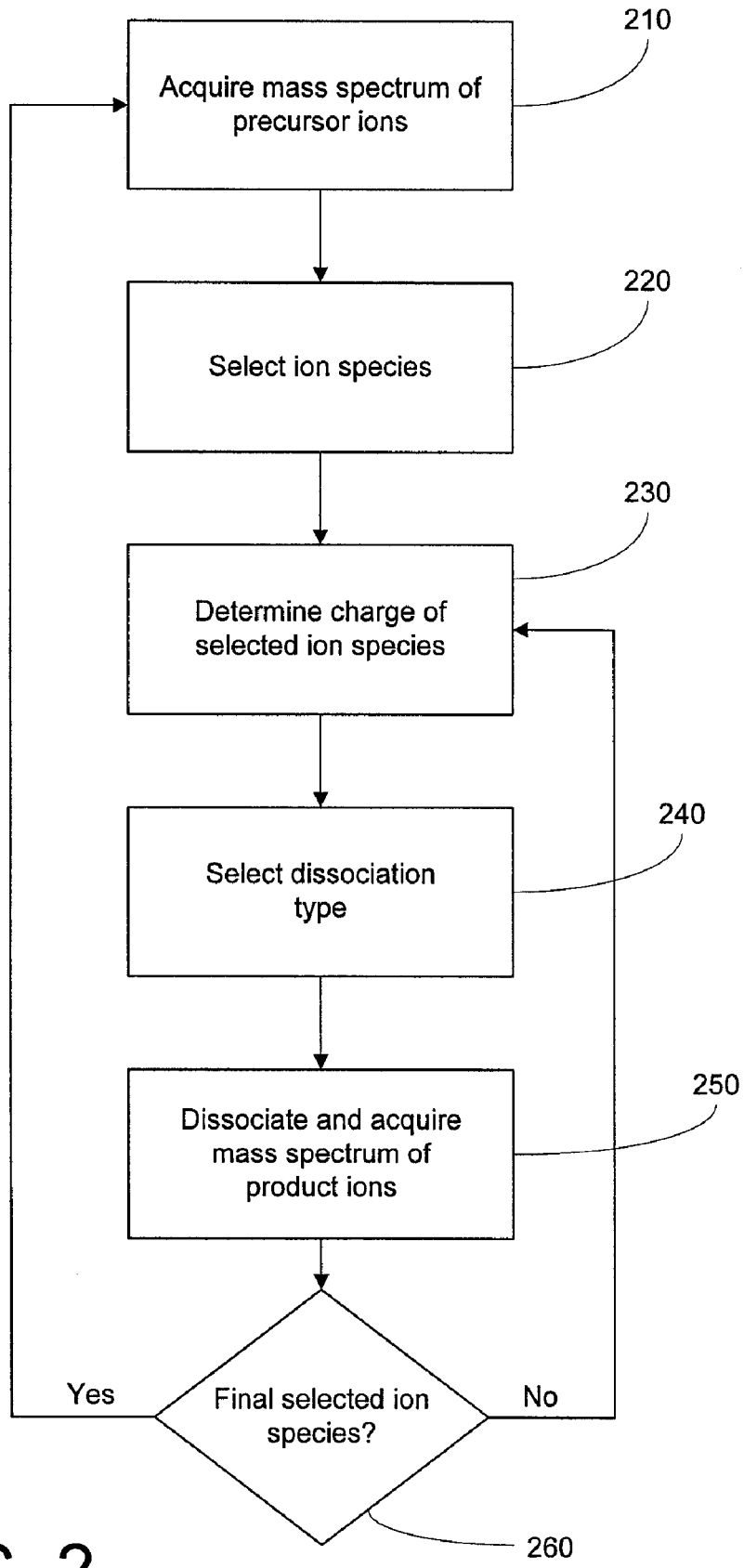
FIG. 2 is a flowchart depicting the steps of a data-dependent method for selecting dissociation type using criteria based on the determined charge state of an ion species of interest, in accordance with an illustrative embodiment of the invention.

FIG. 2 is a flowchart of a method for data-dependent selection of dissociation type, according to a specific implementation of the present invention. As discussed above, the steps of the method may be implemented as a set of software instructions executed on one or more processors associated with controller 140. In a first step 210, data representative of a mass spectrum of analyte ions is acquired by operation of a mass analyzer, such as by mass-sequentially ejecting ions from the interior of ion trap mass analyzer 115 to detectors 150. Although reference is made herein to "mass" analyzers and "mass" spectra, in a shorthand manner consistent with industry usage of these terms, one of ordinary skill in the mass spectrometry art will recognize that the acquired data represents the mass-to-charge ratios (m/z's) of molecules in the analyte, rather than their molecular masses. As is known in the art, the mass spectrum is a representation of the ion intensity observed at each acquired value of m/z. Standard filtering and preprocessing tools may be applied to the mass spectrum data to reduce noise and otherwise facilitate analysis of the mass spectrum. Preprocessing of the mass spectrum may include the execution of algorithms to assign charge states to m/z peaks in the mass spectrum, utilizing a known algorithm for charge state determination.

In step 220, the mass spectrum is processed by controller 140 to select one or more ion species of interest by applying specified input criteria. According to the present example, controller 140 is programmed to select the three ion species yielding the highest intensities in the mass spectrum. Alternative implementations of this method may utilize other input criteria (including but not limited to those listed above) in place of or in combination with the intensity criteria.

In the next step 230, the charge state of the selected ion species is determined by analysis of the acquired mass spectrum. Various techniques are known in the art for the determination of ion charge state from the analysis of mass spectra. Examples of such techniques include the following:

1. If the mass spectrometric resolution is sufficiently high, the separation of the components of the isotopic cluster m/z peaks for a particular ion species allows determination of the charge state; thus, the separation in m/z units is ~1/n (Dalton/unit charge), where n is the charge state. In certain cases, sufficiently high resolution may be obtained by performing one or more slow-speed scans (mass spectra) of limited mass range centered around the m/z value of the ion species of interest.
2. The observation of different cationized species of the same charge number and derived from the same neutral analyte may allow direct determination of the charge state; for example, sodium cations may replace protons in the formation of positive ions, yielding ions that are separated from the fully protonated analog by ~22/n (Dalton/unit charge).
3. For proteins and other high molecular mass analytes, an ion series representative of a broad range of charge states is commonly observed. The charge state of a particular ion species may be derived from the measured m/z's of the ion species of interest and the adjacent member of the ion series.
4. Ions may be deliberately dissociated, either within the source or the mass analyzer/dissociation device, and the charge state determined by comparing the measured m/z values of the product ions with expected values.
5. The ions may be subjected to one or more stages of charge reduction via proton transfer or other charge-reducing reactions, and the charge state may be deduced by comparing the original mass spectrum with the mass spectrum of the charge-reduced ions.

The foregoing list is intended as illustrative rather than limiting, and those in the art will recognize that many other techniques are or may become available for determination of charge state. More accurate and reliable determination of charge state may be achieved by combining two or more of the foregoing techniques (or other charge state determination techniques). The selection of the appropriate charge state determination technique will be guided by considerations of the requisite accuracy/reliability of the determined charge state, the analyte type, the mass analyzer type, and computational expense (bearing in mind that multiple data-dependent acquisition cycles may need to be completed across a chromatographic elution peak of relatively short duration). In one implementation, the operator may specify or select a desired charge state determination technique from a list of available techniques prior to performing the analysis. It should be further noted that the charge state determination may be performed as part of the preprocessing operations discussed above, i.e., prior to or concurrently with selection of an ion species of interest.

As used herein, the term charge state may denote either a single value (e.g., +2) or a range of values (e.g., +2-4 or >+6). In certain implementations, it may not be necessary to determine the exact value of the charge state of the ion species of interest, but instead it may suffice, for the purposes of making the data-dependent decision, to assess whether the ion species of interest is either singly-charged or multiply-charged, or alternatively whether the ion species has a charge state that lies within one of a set of value ranges, e.g., +1, +2-3, +4-6, >+6. This determination can typically be conducted by application of a relatively simple, low computational cost algorithm.

It is further noted that certain charge state determination techniques require acquisition of only a single mass spectrum, whereas others rely on acquisition and processing of multiple mass spectra (e.g., enhanced-resolution scans or product ion spectra). Given the time constraint imposed by the duration of chromatographic elution, it is generally desirable to employ a charge state determination technique that provides acceptable accuracy and reliability while consuming as little time as possible in order to ensure that sufficient time is available to complete an adequate number of data-dependent acquisition cycles during the elution period.

Following determination of the charge state of the selected ion species, data system 140 uses the determined charge state to select the dissociation type in accordance with the specified relationship between the input criteria and output actions, step 240. FIGS. 3 and 4 illustrate examples of specified relationships between input criteria and dissociation type. In the first example, depicted in the FIG. 3 table (in which the filled dots indicate the technique to be utilized), the selection of dissociation type (CAD, ETD alone, or ETD followed by CAD or PTR) is based solely on charge state: singly-charged ions are dissociated by CAD; ions having a charge state of +2 are dissociated by ETD followed by supplemental collisional activation (designated as ETD+CAD); ions having a charge state of between +3 and +6 are dissociated by ETD alone, and; ions having a charge state of +7 and above are dissociated by ETD followed by PTR. In the second example, depicted in FIG. 4, the input criteria are based both on charge state and m/z. More specifically, for ions having charge states of between +3 and +6, the selected dissociation type depends both on the ion's charge state and whether its m/z is less or greater than a specified value.

The foregoing examples are intended to illustrate how the invention may be implemented in a specific instance, and should not be construed as limiting the invention to any particular relationship between the determined ion species parameter and the selected dissociation type. The input criteria-dissociation type relationship employed for a given experiment will be formulated in view of various operational considerations and experimental objectives. The relationship may be simple (for example, switching between two dissociation types based solely on the charge state parameter), or may instead be highly complex, having several candidate dissociation types selectable according to a scheme based on multiple parameters, including but not limited to charge state, charge state density, m/z, mass, intensity, intensity pattern, neutral loss, product ion mass, m/z inclusion and exclusion lists, and structural information. For example, for a given precursor ion m/z, multiple MS/MS spectra may be acquired using different dissociation methods, For instance, +2 charge state peptide precursors having an m/z<600 will likely yield product ion spectra providing complementary information via both CAD and ETD followed by CAD.

In should be noted that in certain implementations, one possible data dependent output action is to refrain from any dissociation (and acquisition of an MS/MS spectrum) of a selected ion species, where such MS/MS spectrum is unlikely to yield meaningful information.

In step 250, an MS/MS or MS″ spectrum is acquired for the selected ion species utilizing the dissociation type chosen in step 240. As is known in the art, acquisition of the MS/MS spectrum will typically involve refilling analyzer 115 with an ion population including the selected ion species and isolation of the selected ion species by applying a supplemental AC waveform that ejects all ions outside of the m/z range of interest, followed by resonant excitation of the selected ion species (for CAD or PQD), or mixing the ion species with reagent ions of opposite polarity (for ETD). The mass spectrum of the product ions may be generated by standard methods of mass-sequential ejection.

Per step 260, the charge state determination, dissociation type selection, and MS/MS spectrum acquisition steps are repeated for each of the selected ion species. Upon completion of this cycle, the method returns to step 210 for selection of a new set of ion species of interest.

While the foregoing embodiment has been described with reference to analyte cations (i.e., all analyte ions have been assigned positive charge states), it should be noted that the method and apparatus of the present invention is equally well-suited to analysis of analyte anions, wherein the list of candidate dissociation types may include negative electron transfer dissociation (NETD) and other techniques specially adapted for dissociation of analyte anions.

It will be recognized that the data-dependent methods described herein, whereby input criteria based at least partially on a determined charge state are applied to select a dissociation type, may be extended to other data-dependent output actions. For example, in a hybrid mass spectrometer having two distinct analyzer types (such as the LTQ Orbitrap mass spectrometer available from Thermo Fisher Scientific), charge state-based criteria may be applied to determine which one of the available analyzers is employed to produce a mass spectrum of ions derived from an ion species of interest (or, in another implementation, which dissociation device is utilized). Other output actions which may be selected by application of charge state based criteria include scan rate, analyzer mass range, and data processing algorithms.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An method of analyzing a sample in a mass spectrometer, comprising:

acquiring a mass spectrum of ions derived from the sample;

selecting an ion species of interest from the mass spectrum;

determining a charge state of the selected ion species;

automatically selecting, using a controller of the mass spectrometer, a dissociation type from a plurality of distinct candidate dissociation types in accordance with a specified relationship between at least one measured parameter of the selected ion species and dissociation type, the at least one parameter including the charge state; and dissociating the identified ion species using the selected dissociation type.

2. The method of claim 1, wherein the specified relationship is based on both the charge state and on a measured mass-to-charge ratio of the selected ion species.

3. The method of claim 1, wherein the step of determining the charge state includes acquiring an enhanced resolution mass spectrum around the selected ion species.

4. The method of claim 1, wherein the step of determining the charge state includes:

acquiring a second mass spectrum of the selected ion species utilizing a non-dissociative charge-reducing reaction to facilitate determination of the charge state.

5. The method of claim 4, wherein the non-dissociative charge-reducing reaction is an ion-ion reaction.

6. The method of claim 1, wherein the plurality of candidate dissociation types includes electron transfer dissociation (ETD).

7. The method of claim 1, wherein the plurality of candidate dissociation types includes pulsed-q dissociation (PQD).

8. The method of claim 1, wherein the plurality of candidate dissociation types includes collisionally activated dissociation (CAD).

9. The method of claim 1, wherein the plurality of candidate dissociation types includes ETD followed by non-dissociative charge-reducing reaction.

10. The method of claim 9, wherein the non-dissociative charge-reducing reaction is an ion-ion reaction.

11. The method of claim 1, wherein the plurality of candidate dissociation types includes photodissociation.

12. The method of claim 1, wherein the plurality of candidate dissociation types includes surface-induced dissociation.

13. A mass spectrometer, comprising:

an ion source for generating ions from a sample;

a mass analyzer operable to acquire a mass spectrum of the ions;

a controller, coupled to the mass analyzer, including logic for:

selecting an ion species of interest from the mass spectrum; and determining a charge state of the selected ion species; and automatically selecting a dissociation type from a plurality of distinct candidate dissociation types in accordance with a specified relationship between at least one measured parameter of the selected ion species and dissociation type, the at least one parameter including the charge state; and at least one dissociation device, coupled to the controller, operable to dissociate the identified ion species using the selected dissociation type.

14. The mass spectrometer of claim 13, wherein the specified relationship is based on both the charge state and the measured mass-to-charge ratio of the selected ion species.

15. The mass spectrometer of claim 13, wherein the controller includes logic for causing the mass analyzer to acquire an enhanced resolution mass spectrum around the selected ion species to facilitate determination of the charge state.

16. The mass spectrometer of claim 13, wherein the mass analyzer and at least one dissociation device are combined into an integral device.

17. The mass spectrometer of claim 16, wherein the integral device includes a two-dimensional ion trap mass analyzer.

18. The mass spectrometer of claim 16, wherein the integral device includes a three-dimensional ion trap mass analyzer.

19. The method of claim 1, wherein the plurality of distinct dissociation types includes collisionally activated dissociation and electron transfer dissociation, and wherein the step of selecting a dissociation type includes selecting collisionally activated dissociation if the selected ion species is singly charged and selecting electron transfer dissociation if the selected ion species has a charge of at least 3.

* * * * *